United States Patent [19]

Yanagida et al.

[11] 4,347,080

[45] Aug. 31, 1982

[54] AUSTENITIC FREE-CUTTING STAINLESS STEEL

[75] Inventors: Minoru Yanagida, Ohbu; Tomio Kono, Nagoya, both of Japan

[73] Assignee: Daido Tokushuko K.K., Nagoya, Japan

[21] Appl. No.: 223,034

[22] Filed: Jan. 7, 1981

[30] Foreign Application Priority Data

| | | | |
|---|---|---|---|
| Jan. 12, 1980 | [JP] | Japan | 55/1749 |
| Sep. 18, 1980 | [JP] | Japan | 55/128635 |
| Oct. 17, 1980 | [JP] | Japan | 55/144409 |

[51] Int. Cl.[3] ..... C22C 38/06

[52] U.S. Cl. ..... 75/124; 75/125; 75/128 P; 75/128 E; 75/128 F; 75/128 N; 75/128 G; 75/128 Z; 75/128 T; 75/128 W; 75/128 V

[58] Field of Search ..... 75/128 A, 128 P, 128 F, 75/128 E, 128 N, 128 W, 124 C, 124 F, 125, 128 C, 128 G, 128 Z, 128 T, 128 V

[56] References Cited

U.S. PATENT DOCUMENTS

| | | | |
|---|---|---|---|
| 2,215,374 | 9/1940 | Harder | 75/128 P |
| 3,362,813 | 1/1968 | Ziolkowski | 75/124 C |
| 3,784,373 | 1/1974 | Ornitz et al. | 75/128 F |
| 3,853,545 | 12/1974 | Kusaka et al. | 75/128 P |
| 4,049,430 | 9/1977 | Myers | 75/128 F |
| 4,078,920 | 3/1978 | Liljas et al. | 75/128 E |
| 4,172,716 | 10/1979 | Abo et al. | 75/128 F |
| 4,227,923 | 10/1980 | Watanabe et al. | 75/128 P |

*Primary Examiner*—John P. Sheehan

*Attorney, Agent, or Firm*—Armstrong, Nikaido, Marmelstein & Kubovcik

[57] ABSTRACT

In austenitic free-cutting stainless steel containing lead, decrease of hot workability caused by the addition of lead can be dissolved by adding a specific amount of boron. Thus, there is obtained an austenitic free-cutting stainless steel with improved machinability, corrosion resistance and hot workability of which are maintained at the level of conventional austenitic stainless steel.

7 Claims, No Drawings

AUSTENITIC FREE-CUTTING STAINLESS STEEL

BACKGROUND OF THE INVENTION

1. Field of the Invention

The present invention relates to a novel austenitic free-cutting stainless steel which has improved machinability without deteriorating corrosion resistance and hot workability.

2. State of the Art

There has been proposed and used various types of austenitic free-cutting steel containing mechinability-improving element or elements such as sulfur, selenium and calcium solely or in combination. Although these austenitic free-cutting stainless steel have good machinability, corrosion resistance and hot workability thereof are generally dissatisfactory.

We have investigated austenitic free-cutting stainless steel having not only good machinability but also satisfactory corrosion resistance and hot workability which are inherent in conventional austentic stainless steel.

It was our discovery that addition of a suitable amount of lead to the austenitic stainless steel is effective to improve machinability without deteriorating corrosion resistance. However, we encountered a novel problem that the hot workability of the steel is deteriorated in return for the improved corrosion resistance.

SUMMARY OF THE INVENTION

Accordingly, the object of the present invention is to provide an alloy composition of austenitic free-cutting stainless steel which has not only a good corrosion resistance but also a hot workability of satisfactory level.

This object can be achieved, in accordance with the present invention, by adding a specific amount of boron to the known austenitic free-cutting stainless steel containing lead. In other words, decrease of the hot workability caused by lead which is added for the purpose of improving the machinability is dissolved or compensated by the addition of boron.

The effect of boron will be strengthened by a suitable amount of one or more of optionally added element selected from the group consisting of aluminum, titanium, niobium, tantalum, tungsten, vanadium, zirconium and rare earth metals of the lanthanide series (hereinafter referred to as "REM").

The corrosion resistance of the present steel can be further improved by at least one of optional additives, copper and molybdenum in a suitable amount.

DESCRIPTION OF PREFERRED EMBODIMENTS

The austenitic free-cutting stainless steel of the present invention has the basic composition shown below:

| | | | |
|---|---|---|---|
| C: | 0.005 to 0.2% | S: | 0.005 to 0.07% |
| Si: | 0.01 to 2.0% | N: | 0.003 to 0.10% |
| Mn: | 0.01 to 20% | Pb: | 0.03 to 0.40% |
| Cr: | 12 to 30% | B: | 0.0005 to 0.030% |
| Ni: | 2 to 20% | Fe: | balance |

In the above wide ranges of the composition, typical alloy compositions are defined as the following I, II and III:

| | I | II | III |
|---|---|---|---|
| C: | 0.005 to 0.08 | 0.005 to 0.20 | 0.005 to 0.10 |
| Si: | 0.01 to 2.0 | 0.01 to 2.0 | 0.01 to 2.0 |
| Mn: | 0.01 to 2.0 | 2.0 to 20.0 | 0.01 to 2.0 |
| Cr: | 16 to 20 | 16 to 30 | 12 to 30 |
| Ni: | 8 to 14 | 2 to 15 | 6 to 20 |
| S: | 0.005 to 0.07 | 0.005 to 0.07 | 0.005 to 0.07 |
| N: | 0.003 to 0.10 | 0.003 to 0.10 | 0.003 to 0.10 |

The present steel of the above basic composition may further contain one or more of the members selected from the group consisting of Al, Ti, Nb, Ta, W, V and Zr in an amount up to 3.0%.

Also, this steel may contain, in addition to or in lieu of these additive elements, one or more of the REM in an amount up to 1.0%.

Further, the present steel may contain one or both of Cu and Mo in an amount up to 4.0%.

The following explains roles of the above noted basic and optional components of the steel and significance of the composition.

C: 0.005 to 0.2%

Carbon is an austenitizing element, but it is not essential. However, it is difficult to decrease the content to 0.005% or less in commercial steel refining process. Too much content more than 0.2% affects the corrosion resistance.

Si: 0.01 to 2.0%

Silicon is used as a deoxidizing element, and usually at least 0.01% is contained. It increases resistance to oxidation and resistance to stress corrosion-crack. Because excess silicon causes formation of ferrite, and damage toughness and hot workability, the amount should be limited to 2.0%.

Mn: 0.01 to 20%

Manganese is added as a deoxidizing agent at the time of making steel, and at least 0.01% remains in the steel. It combines with sulfur to form MnS and arrests hot enbrittlement and stabilizes austenite phase.

Too high a content of Mn deteriorates both corrosion resistance and hot workability, and 20% is the upper limit.

In the above wide reange of the composition, if an excellent corrosion resistance is desired, it is recommened that a lower Mn content, up to 2.0% is chosen, and if saving expensive Ni is desired, a higher Mn content more than 2.0% should be used.

S: 0.005 to 0.07%

As well known, sulfur improves machinability of the steel. Much sulfur, more than 0.07%, significantly damages the corrosion resistance.

Cr: 12.0 to 30.0%

Chromium is rather a ferrite-forming element. In order that a stainless steel has a proper corrosion resistance, it should contain at least 12.0%, preferably 15 to 16% or more of Cr. On the other hand, under coexistence with 2 to 20% of Ni, a Cr content higher than 30% causes appearance of ferrite phase in austenite phase, and no longer brings about further improvement. In order to maintain stable austenite phase, Cr content is preferably up to 20%.

Ni: 2.0 to 20%

Nickel is important as a strong austenite-stabilizing element. For the purpose of obtaining a perfect austenite structure under coexistence with 12 to 30% Cr, at least 6.0%, preferably 8.0% or more of Ni should be contained. A portion of required Ni amount can be replaced with Mn, and the lower limit of Ni content can be as low as about 2.0%. At a higher content, increase of Ni amount does not improve the properties of the steel any more, and upper limit, 20% is thus determined.

N: 0.003 to 0.10%

Nitrogen stabilizes austenitic phase. In commercial steel refining process, it is difficult to decrease the content as low as 0.003%. It is easily dissolved in austenitic stainless steel, but a large amount thereof, more than 0.10% affects the hot workability.

Pb: 0.03 to 0.40%

Lead which is added in the steel exists in the form of discrete fine metallic particles or in combination with sulfides such as MnS, thus giving lubricating effect at the time of machining the steel to lengthen life of the machining tools. For this purpose, 0.03% or more of Pb is necessary. Increased Pb content is unfavorable to the hot workability, and 0.40% or less is preferred.

B: 0.0005 to 0.030%

In order to suppress deterioration of the hot workability of the austenitic free-cutting stainless steel caused by lead, at least 0.0005% of boron must be contained in the steel. If, however, boron content exceeds 0.030%, there will be formation of low melting point compounds which are undesirable to the hot workability.

Al, Ti, Nb, Ta, W, V and Zr: up to 3.0%

REM: up to 1.0%

The effect of boron addition, which is to dissolve the problem of lowered hot workability caused by Pb, machinability-improving element, is promoted by addition of at least one member selected from the group consisting of Al, Ti, Nb, Ta, W, V and Zr, and/or at least one of REM. For this purpose, useful least content of the member or members of the former group is 0.05%, and that of the latter group is 0.002%. On the other hand, as the content of these elements becomes higher, they will cause formation of ferrite phase, and further, even be harmful to the hot workability. Thus, the upper limit of the former group was determined to be 3.0%, preferably 2.0%, and that of the latter group, to be 1.0%.

Cu: up to 4.0%

Copper is useful for improving corrosion resistance of the austenitic stainless steel, particularly in nonoxidative acids such as sulfuric acid and phosphoric acid, and in organic acids. Excess content will give unfavorable influence on the hot workability, and the content of Cu should be at highest 4.0%.

Mo: up to 4.0%

The corrosion resistance of the present steel in almost all the conceivable environments can be improved by Mo. Mo becomes, like Cu as noted above, unfavorable to the hot workability at a higher content, and therefore, the content should be at highest also 4.0%, preferably 3.0%.

EXAMPLE I

Austenitic free-cutting stainless steels having the compositions shown in Table I (% by weight) were prepared in an arc furance or an HF (high frequency) induction furnace, and a refining vessel such as RH degassing vessel, argon-oxygen decarburizing vessel and vacuum-oxygen decarburizing vessel. They were cast into ingots weighing 250 kg (upper diameter: 230 mm, lower diameter: 182 mm, and height: 960 mm).

The steel samples were subjected to the tests on hot workability, corrosion resistance and machinability thereof as described below.

In the Table, Run Nos. 4 to 7, 10 and 11, 14 and 15, and 18 bearing "*" are Control Examples.

TABLE I

| Run | C | Si | Mn | S | Ni | Cr | Mo | Cu | N | Pb | B |
|---|---|---|---|---|---|---|---|---|---|---|---|
| 1 | 0.02 | 0.27 | 0.81 | 0.005 | 9.01 | 18.25 | — | — | 0.01 | 0.19 | 0.004 |
| 2 | 0.06 | 0.21 | 0.88 | 0.025 | 9.12 | 18.23 | — | — | 0.03 | 0.18 | 0.006 |
| 3 | 0.08 | 0.28 | 0.84 | 0.011 | 8.94 | 18.01 | — | — | 0.08 | 0.17 | 0.005 |
| 4* | 0.05 | 0.28 | 0.86 | 0.013 | 9.08 | 18.19 | — | — | 0.03 | — | — |
| SUS30 4 | | | | | | | | | | | |
| 5* | 0.06 | 0.33 | 1.56 | 0.204 | 9.09 | 18.19 | — | — | 0.03 | — | — |
| SUS30 3 | | | | | | | | | | | |
| 6* | 0.06 | 0.24 | 0.82 | 0.014 | 9.21 | 18.91 | — | — | 0.14 | 0.20 | 0.007 |
| 7* | 0.05 | 0.30 | 0.90 | 0.009 | 9.08 | 18.31 | — | — | 0.04 | 0.19 | — |
| 8 | 0.03 | 0.29 | 0.84 | 0.024 | 9.03 | 18.14 | — | 1.03 | 0.02 | 0.23 | 0.007 |
| 9 | 0.07 | 0.28 | 0.83 | 0.017 | 9.14 | 18.20 | — | 2.14 | 0.03 | 0.20 | 0.005 |
| 10* | 0.04 | 0.28 | 0.90 | 0.033 | 9.01 | 18.21 | — | 1.14 | 0.13 | 0.19 | 0.004 |
| 11* | 0.06 | 0.26 | 0.83 | 0.018 | 9.15 | 18.03 | — | 1.52 | 0.03 | 0.01 | 0.005 |
| 12 | 0.05 | 0.54 | 0.79 | 0.021 | 10.12 | 16.45 | 2.11 | — | 0.03 | 0.20 | 0.006 |
| 13 | 0.02 | 0.51 | 0.82 | 0.020 | 9.85 | 17.10 | 2.15 | — | 0.05 | 0.15 | 0.004 |
| 14* | 0.03 | 0.45 | 0.80 | 0.021 | 9.30 | 18.01 | 2.00 | — | 0.05 | — | — |
| 15* | 0.06 | 0.48 | 0.77 | 0.009 | 9.03 | 16.41 | 2.07 | — | 0.03 | 0.19 | — |
| 16 | 0.02 | 0.50 | 0.79 | 0.020 | 10.30 | 16.20 | 2.20 | 1.02 | 0.03 | 0.18 | 0.006 |
| 17 | 0.06 | 0.49 | 0.80 | 0.014 | 10.21 | 16.31 | 2.18 | 3.10 | 0.03 | 0.20 | 0.006 |
| 18* | 0.06 | 0.53 | 0.87 | 0.019 | 10.28 | 16.34 | 2.07 | 1.13 | 0.02 | 0.17 | — |

(1) Evaluation of Hot Workability

The above noted ingots were processed by hot forging to be rods of diameter 60 mm, and the rods were visually inspected on crack on the surface for evaluating the hot workability of the steels.

The results are shown in Table II. In the Table, mark "A" shows that there was observed no crack or, even if any, very slight cracks; "B," medium cracks; and "C," so serious cracks that no sample rod was obtained due to the cracks.

It is seen from the Table that the steels according to the present invention has the hot workability nearly equal to that of conventional austenitic stainless steel, and that, despite addition of Pb, deterioration of the hot workability was avoided.

(2) Evaluation of Corrosion Resistance

The above 250 kg ingots were hot forged to rods of diameter 20 mm (some of the ingots, which cracked during the hot forging were then machined to the rods.), and the rods were subjected to the solution-treatment at 1,100° C. for 1 hour, followed by water quenching.

Specimens, those of 18 mm dia. and 20 mm long, for sulfuric acid test, and those of 18 mm. dia. and 100 mm long for salt spray test were prepared from the above treated rods by machining.

The specimens were subjected to the sulfuric acid corrosion test in accordance with the method defined by JIS G-0591 using 5%-$H_2SO_4$, and to the salt spray test defined by JIS Z-2371. The results were given in Table II. In the Table, column of salt spray test, mark "A" indicates no rust, and "B," occurrence of some rust.

As seen from the Table, the steel of the present invention has the corrosion resistance of the same level as that of the conventional austenitic stainless steel.

(3) Evaluation of Machinability

The above rods of diameter 60 mm which were made by hot forging and solution-treated were subjected to drilling test using HSS twist drills under the conditions given below. The results are also shown in Table II. In the Table, mark "*" indicates that it was unable to make specimen from the ingots due to cracking during hot forging.

TOOL LIFE TEST WITH HSS TWIST DRILL

Test piece: 60 mm dia.—50 mm long
Tool: SKH, tapered shank drill
Feed: 0.15 mm/rev.
Depth of hole: 20 mm, blind hole in the forging direction
Cutting oil: none
Results shown in the Table: life speed at the point where the life is 1000 mm on the tool life curve, $V_{L=1000}$ (m/min.)

The data in the Table clearly show the superior machinability of the present steel to that of the conventional austenitic stainless steel.

TABLE II

| Run | Hot Workability | Corrosion Resistance 5%-$H_2SO_4$ (g/m$^2$.Hr) | Corrosion Resistance Salt Spray | Machinability HSS Drill |
|---|---|---|---|---|
| 1 | A | 41.4 | A | 18.8 |
| 2 | A | 49.2 | A | 17.4 |
| 3 | B | 44.3 | A | 18.1 |
| 4* | A | 45.2 | A | 8.3 |
| SUS30 4 | | | | |
| 5* | A | 621.4 | B | 20.0 |

TABLE II-continued

| Run | Hot Workability | Corrosion Resistance 5%-$H_2SO_4$ (g/m$^2$.Hr) | Corrosion Resistance Salt Spray | Machinability HSS Drill |
|---|---|---|---|---|
| SUS30 3 | | | | |
| 6* | C | 50.6 | A | * |
| 7* | C | 43.8 | A | * |
| 8 | A | 10.4 | A | 18.2 |
| 9 | B | 9.6 | A | 19.3 |
| 10* | C | 15.3 | A | * |
| 11* | B | 12.9 | A | 10.1 |
| 12 | A | 5.9 | A | 18.9 |
| 13 | A | 7.3 | A | 17.7 |
| 14* | A | 5.3 | A | 9.0 |
| 15* | C | 6.9 | A | * |
| 16 | A | 4.8 | A | 18.1 |
| 17 | B | 5.0 | A | 18.8 |
| 18* | C | 4.2 | A | * |

EXAMPLE II

Steels of the compositions shown in Table III were prepared in the same manner as Example I, and cast into the ingots of 250 kg, dimensions thereof being the same as those of Example I.

The ingots were hot processed, solution treated, and then, the resulting test pieces were subjected to the tests on the corrosion resistance and the machinability. Evaluation of the hot workability was made in the same way as described in Example I. The corrosion resistance was determined by the 5%-$H_2SO_4$ corrosion test at room temperature, and the salt spray test. The machinability was determined by the drilling test using the HSS twist drill.

The test results are shown in Table IV.

In the Table, Run Nos. 14 to 21 bearing "*" are Control Examples.

The Table teaches that the hot workability of the present steel is at the same level as that of the conventional austenitic stainless steel, and that the possible deterioration of the hot workability caused by Pb is removed by the addition of B, or B and one of Al, Ti, Nb, Ta, W, V, Zr and REM.

Also, the Table indicates that the corrosion resistance of the present steel equals to that of the conventional austenitic stainless steel.

It is quite clear from the Table that the machinability of this steel is better than that of the conventional austenitic stainless steel.

TABLE III

| Run | C | Si | Mn | S | Ni | Cr | Mo | Cu | N | Pb | B | Others |
|---|---|---|---|---|---|---|---|---|---|---|---|---|
| 1 | 0.11 | 0.38 | 5.72 | 0.021 | 3.64 | 16.20 | — | — | 0.03 | 0.21 | 0.007 | — |
| 2 | 0.12 | 0.48 | 5.83 | 0.015 | 3.60 | 16.31 | — | — | 0.06 | 0.28 | 0.021 | — |
| 3 | 0.09 | 0.48 | 8.06 | 0.042 | 5.88 | 17.21 | — | — | 0.04 | 0.23 | 0.013 | — |
| 4 | 0.09 | 0.78 | 8.17 | 0.021 | 11.31 | 21.60 | — | — | 0.03 | 0.21 | 0.006 | — |
| 5 | 0.10 | 0.41 | 5.69 | 0.018 | 3.68 | 16.18 | 1.21 | — | 0.05 | 0.32 | 0.006 | — |
| 6 | 0.12 | 0.43 | 8.08 | 0.025 | 5.79 | 17.30 | — | 2.01 | 0.08 | 0.23 | 0.020 | — |
| 7 | 0.11 | 1.38 | 12.31 | 0.023 | 11.04 | 21.71 | 1.08 | 2.09 | 0.03 | 0.25 | 0.007 | — |
| 8 | 0.12 | 0.42 | 5.73 | 0.021 | 3.58 | 16.08 | — | — | 0.03 | 0.17 | 0.014 | Ti: 1.41, REM: 0.14 |
| 9 | 0.11 | 0.40 | 8.00 | 0.019 | 5.83 | 17.32 | — | — | 0.04 | 0.22 | 0.006 | Nb: 0.21, W: 0.28, Zr: 1.23 |
| 10 | 0.09 | 1.49 | 12.29 | 0.024 | 11.28 | 22.08 | — | — | 0.03 | 0.24 | 0.009 | Ti: 0.24, V: 0.19 |
| 11 | 0.09 | 0.38 | 5.78 | 0.023 | 3.63 | 16.19 | 1.09 | — | 0.03 | 0.13 | 0.017 | Nb: 0.28, Ta: 0.09 |
| 12 | 0.10 | 0.45 | 8.12 | 0.025 | 5.79 | 17.28 | — | 2.10 | 0.02 | 0.29 | 0.006 | Al: 0.23, Zr: 0.21 |
| 13 | 0.11 | 1.31 | 13.09 | 0.019 | 12.04 | 21.09 | 1.15 | 2.18 | 0.03 | 0.22 | 0.008 | V;1.23 |
| 14* | 0.12 | 0.35 | 5.68 | 0.021 | 3.70 | 16.20 | — | — | 0.03 | | — | — |
| 15* | 0.09 | 0.32 | 5.63 | 0.030 | 3.65 | 16.31 | — | — | 0.03 | 0.23 | — | — |
| 16* | 0.11 | 0.35 | 8.05 | 0.026 | 5.75 | 17.30 | — | — | 0.16 | 0.16 | 0.007 | — |
| 17* | 0.12 | 0.38 | 5.60 | 0.024 | 7.64 | 16.29 | 1.20 | — | 0.03 | 0.45 | 0.006 | — |
| 18* | 0.10 | 0.34 | 8.11 | 0.026 | 5.81 | 17.38 | 1.26 | 2.18 | 0.04 | 0.01 | 0.008 | — |
| 19* | 0.13 | 0.39 | 5.58 | 0.020 | 3.60 | 16.29 | — | — | 0.03 | 0.26 | — | Nb: 0.03 |
| 20* | 0.12 | 0.30 | 8.20 | 0.024 | 5.83 | 17.08 | — | — | 0.03 | 0.23 | 0.038 | Zr: 0.25 |

TABLE III-continued

| Run | C | Si | Mn | S | Ni | Cr | Mo | Cu | N | Pb | B | Others |
|---|---|---|---|---|---|---|---|---|---|---|---|---|
| 21* | 0.11 | 0.34 | 5.60 | 0.014 | 3.54 | 16.21 | 1.34 | — | 0.15 | 0.24 | 0.007 | Ti: 0.31 |

TABLE IV

| Run | Hot Workability | Corrosion Resistance 5%-$H_2SO_4$ ($g/m^2$.Hr) | Corrosion Resistance Salt Spray | Machinability HSS Drill |
|---|---|---|---|---|
| 1 | A | 5.7 | A | 9.1 |
| 2 | A | 6.1 | A | 11.5 |
| 3 | A | 5.2 | A | 10.3 |
| 4 | A | 4.3 | A | 9.7 |
| 5 | A | 3.1 | A | 12.1 |
| 6 | A | 3.2 | A | 9.9 |
| 7 | A | 2.6 | A | 9.7 |
| 8 | A | 5.8 | A | 8.9 |
| 9 | A | 5.4 | A | 9.8 |
| 10 | A | 4.0 | A | 9.5 |
| 11 | A | 3.0 | A | 9.0 |
| 12 | A | 2.8 | A | 11.5 |
| 13 | A | 2.5 | A | 9.8 |
| 14* | A | 5.9 | A | 4.6 |
| 15* | C | 6.0 | A | * |
| 16* | C | 5.8 | A | * |
| 17* | B | 4.4 | B | 14.3 |
| 18* | A | 3.2 | A | 4.3 |
| 19* | C | 5.9 | A | * |
| 20* | B | 6.2 | A | 8.3 |
| 21* | C | 3.4 | A | * |

EXAMPLE III

The same procedures as Examples I and II were repeated to prepare the steel ingots having the composition shown in Table V. Subsequent to the hot processing and the solution treatment, determination was made on the hot workability, the corrosion resistance and the machinability of the steels. The methods of testing hot workability and corrosion resistance are identical with those of Example I. As to the machinability, there was conducted the drilling test with HSS twist drill as in Example II.

The results are shown in Table VI.

Run Nos. 15 to 23 in the Table bearing "*" are the Control Examples.

It is readily understood from the Table that the steel according to the present invention has the hot workability and the corrosion resistance which nearly equal to those of the conventional austenitic stainless steel, and the machinability superior to that of the ordinary austenitic stainless steel.

TABLE V

| Run | C | Si | Mn | S | Ni | Cr | Mo | Cu | N | Pb | B | Others |
|---|---|---|---|---|---|---|---|---|---|---|---|---|
| 1 | 0.04 | 0.41 | 0.72 | 0.021 | 9.08 | 18.37 | — | — | 0.03 | 0.20 | 0.006 | — |
| 2 | 0.04 | 0.40 | 0.93 | 0.028 | 7.68 | 18.11 | — | — | 0.02 | 0.35 | 0.008 | — |
| 3 | 0.05 | 0.49 | 1.51 | 0.024 | 11.07 | 18.66 | — | — | 0.08 | 0.18 | 0.004 | — |
| 4 | 0.04 | 0.37 | 0.94 | 0.046 | 14.05 | 18.23 | — | — | 0.03 | 0.26 | 0.026 | — |
| 5 | 0.06 | 0.40 | 0.51 | 0.019 | 9.16 | 20.03 | — | 1.22 | 0.04 | 0.24 | 0.006 | — |
| 6 | 0.04 | 0.44 | 0.77 | 0.021 | 10.32 | 18.41 | 2.14 | — | 0.03 | 0.23 | 0.008 | — |
| 7 | 0.04 | 0.39 | 0.81 | 0.018 | 10.29 | 16.29 | 2.02 | 0.96 | 0.03 | 0.24 | 0.007 | — |
| 8 | 0.06 | 0.39 | 0.82 | 0.023 | 9.02 | 20.08 | — | — | 0.03 | 0.23 | 0.006 | Ti:0.50 |
| 9 | 0.04 | 0.46 | 0.84 | 0.028 | 9.31 | 18.19 | — | — | 0.04 | 0.25 | 0.002 | V:0.06, Zr:0.42 |
| 10 | 0.05 | 0.36 | 1.08 | 0.015 | 9.18 | 19.84 | — | — | 0.05 | 0.21 | 0.004 | Al:0.28, 0.28, REM:0.08 |
| 11 | 0.05 | 0.43 | 1.43 | 0.024 | 9.25 | 21.26 | — | 3.05 | 0.03 | 0.29 | 0.003 | V:0.36, Zr:0.24 |
| 12 | 0.05 | 0.41 | 0.81 | 0.018 | 11.89 | 18.38 | 3.61 | — | 0.03 | 0.27 | 0.006 | Ti:0.41 |
| 13 | 0.06 | 0.47 | 0.79 | 0.017 | 11.53 | 18.21 | 1.32 | 1.54 | 0.04 | 0.19 | 0.004 | Nb:0.21, V:0.29 |
| 14 | 0.05 | 0.44 | 0.83 | 0.020 | 12.51 | 18.20 | 2.11 | 1.89 | 0.04 | 0.23 | 0.007 | W:0.21, Ta:0.18 |
| 15* | 0.05 | 0.28 | 0.86 | 0.013 | 9.08 | 18.19 | — | — | 0.03 | — | — | — |
| 16* | 0.05 | 0.35 | 0.93 | 0.024 | 9.25 | 18.11 | — | — | 0.15 | 0.22 | 0.006 | — |
| 17* | 0.04 | 0.46 | 0.81 | 0.019 | 9.15 | 18.37 | — | — | 0.03 | 0.25 | 0.003 | — |
| 18* | 0.04 | 0.48 | 0.80 | 0.020 | 9.07 | 18.24 | — | 1.04 | 0.02 | 0.48 | 0.006 | — |
| 19* | 0.04 | 0.42 | 0.85 | 0.018 | 10.28 | 16.18 | 2.05 | — | 0.03 | 0.01 | 0.007 | — |
| 20* | 0.04 | 0.41 | 0.93 | 0.015 | 9.08 | 18.20 | — | — | 0.14 | 0.20 | 0.005 | Zr:0.43 |
| 21* | 0.05 | 0.39 | 0.88 | 0.020 | 9.04 | 18.19 | — | — | 0.04 | 0.46 | 0.004 | Ti:0.28, Nb:0.36 |
| 22* | 0.04 | 0.39 | 0.84 | 0.018 | 9.05 | 18.20 | — | 1.30 | 0.14 | 0.24 | 0.006 | Ti:0.24, Zr:0.23 |
| 23* | 0.05 | 0.42 | 0.86 | 0.023 | 10.17 | 16.24 | 2.11 | — | 0.03 | 0.22 | — | Nb:0.03, V:0.01 |

TABLE VI

| Run | Hot Workability | Corrosion Resistance 5%-$H_2SO_4$ ($g/m^2 \cdot Hr$) | Corrosion Resistance Salt Spray | Machinability HSS Drill |
|---|---|---|---|---|
| 1 | A | 54.6 | A | 18.1 |
| 2 | B | 62.4 | A | 25.3 |
| 3 | A | 51.3 | A | 18.3 |
| 4 | A | 42.4 | A | 21.4 |
| 5 | A | 15.6 | A | 20.1 |
| 6 | A | 8.2 | A | 21.8 |
| 7 | A | 6.5 | A | 21.6 |
| 8 | A | 43.4 | A | 17.5 |
| 9 | A | 51.2 | A | 19.9 |
| 10 | A | 48.6 | A | 17.4 |
| 11 | A | 9.9 | A | 20.3 |
| 12 | A | 5.4 | A | 20.9 |
| 13 | A | 6.6 | A | 17.8 |
| 14 | A | 6.0 | A | 20.1 |
| 15* | A | 45.2 | A | 8.3 |
| 16* | C | 41.5 | A | * |
| 17* | C | 46.7 | A | * |
| 18* | C | 16.0 | A | * |
| 19* | A | 8.4 | A | 9.0 |
| 20* | C | 38.5 | A | * |
| 21* | C | 54.8 | B | * |
| 22* | C | 13.8 | A | * |
| 23* | C | 6.6 | A | * |

We claim:

1. An austenitic free-cutting stainless steel which essentially consists of:

C: 0.005 to 0.2%,
Si: 0.01 to 2.0%,
Mn: 0.01 to 20%,
S: 0.005 to 0.07%,
Cr: 12 to 30%,
Ni: 2 to 20%,

N: 0.003 to 0.10%,
Pb: 0.03 to 0.40%,
B: 0.0005 to 0.030%, and the balance being substantially Fe.

2. An austenitic free-cutting stainless steel according to claim 1, which essentially consists of:
C: 0.005 to 0.08%,
Si: 0.01 to 2.0%,
Mn: 0.01 to 2.0%,
S: 0.005 to 0.07%,
Cr: 16 to 20%,
Ni: 8 to 14%,
N: 0.003 to 0.10%,
Pb: 0.03 to 0.30%,
B: 0.001 to 0.01%, and the balance being substantially Fe.

3. An austenitic free-cutting stainless steel according to claim 1, which essentially consists of:
C: 0.005 to 0.20%,
Si: 0.01 to 2.0%,
Mn: 2.0 to 20%,
S: 0.005 to 0.07 %,
Cr: 16 to 30%,
Ni: 2 to 15%,
N: 0.003 to 0.10%,
Pb: 0.03 to 0.40%,
B: 0.0005 to 0.030%, and the balance being substantially Fe.

4. An austenitic free-cutting stainless steel according to claim 1, which essentially consists of:
C: 0.005 to 0.10%,
Si: 0.01 to 2.0%,
Mn: 0.01 to 2.0%,
S: 0.005 to 0.07%,
Cr: 12 to 30%,
Ni: 6 to 20%,
N: 0.003 to 0.10%,
Pb: 0.03 to 0.40%,
B: 0.001 to 0.30%, and the balance being substantially Fe.

5. An austenitic free-cutting stainless steel according to one of claims 1 to 4, which further contains one or both of:
(a) at least one chamber selected from the group consisting of Al, Ti, Nb, Ta, W, V and Zr: up to 3.0%, and
(b) at least one of REM (rare earth metals of lanthanide series): up to 1.0%.

6. An austenitic free-cutting stainless steel according to one of claims 1 to 4, which further contains one or both of Cu and Mo: up to 4.0%.

7. An austenitic free-cutting stainless steel according to one of claims 1 to 4, which further contains one or both of:
(a) at least one member selected from the group consisting of Al, Ti, Nb, Ta, W, V and Zr: up to 3.0%, and
(b) at least one of REM (rare earth metals of lanthanide series): up to 1.0%, and one or both of Cu and Mo: up to 4.0%.

* * * * *